US008195083B2

(12) United States Patent
Bahrami et al.

(10) Patent No.: US 8,195,083 B2
(45) Date of Patent: Jun. 5, 2012

(54) DUPLEX ARCHITECTURE FOR AN IMAGING APPARATUS

(75) Inventors: Hassan Bahrami, Lexington, KY (US); Danny Keith Chapman, Sadieville, KY (US); Joon Won Ha, Lexington, KY (US); Kevin Dean Schoedinger, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 1006 days.

(21) Appl. No.: 12/046,057

(22) Filed: Mar. 11, 2008

(65) Prior Publication Data

US 2009/0166944 A1 Jul. 2, 2009

Related U.S. Application Data

(60) Provisional application No. 61/017,076, filed on Dec. 27, 2007.

(51) Int. Cl.
*G03G 15/00* (2006.01)

(52) U.S. Cl. ..... 399/401; 399/405

(58) Field of Classification Search ..... 399/401, 399/405

See application file for complete search history.

(56) References Cited

U.S. PATENT DOCUMENTS

| | | | | |
|---|---|---|---|---|
| 5,758,251 | A * | 5/1998 | Takahashi et al. | 399/395 |
| 5,765,081 | A * | 6/1998 | Bogaert et al. | 399/299 |
| 6,317,581 | B1 * | 11/2001 | Boehmer et al. | 399/401 |
| 6,470,169 | B2 * | 10/2002 | Nakazato | 399/388 |
| 6,947,701 | B2 * | 9/2005 | Uchida et al. | 399/401 |
| 7,277,670 | B2 * | 10/2007 | Yuasa | 399/401 |
| 7,551,887 | B2 * | 6/2009 | Ohtsuki | 399/401 |
| 7,570,897 | B2 * | 8/2009 | Nihei | 399/82 |
| 2002/0039507 | A1 * | 4/2002 | Kawasumi et al. | 399/388 |
| 2002/0131787 | A1 * | 9/2002 | Shimizu et al. | 399/82 |

* cited by examiner

*Primary Examiner* — Anthony Nguyen
(74) *Attorney, Agent, or Firm* — John Victor Pezdek

(57) ABSTRACT

An imaging apparatus including an image transfer device, a first motor, a redrive section and a duplexing section. The first motor is drivingly connected to the image transfer device. The reversible redrive section is downstream from the image transfer device, and the reversible redrive section includes a second motor. The duplexing section includes a third motor. The duplexing section is positioned to receive media from the redrive section. The first motor, the second motor and the third motor are each independently controlled.

13 Claims, 8 Drawing Sheets

DUPLEX ARCHITECTURE FOR AN IMAGING APPARATUS

CROSS-REFERENCE TO RELATED APPLICATIONS

This is a non-provisional application based upon U.S. provisional patent application Ser. No. 61/017,076 entitled "DUPLEX ARCHITECTURE FOR AN IMAGING FOR AN IMAGING APPARATUS", filed Dec. 27, 2007 which is incorporated herein by reference.

MICROFICHE APPENDIX

None.

GOVERNMENT RIGHTS IN PATENT

None.

BACKGROUND OF THE INVENTION

1. Field of the Invention

The present invention relates to an imaging apparatus, and more particularly to the printing section of an imaging apparatus having a duplex architecture.

2. Description of the Related Art

In an image forming apparatus, such as a laser printer, ink jet printer, copy machine or the like, often it is desirable to form an image on both sides of the substrates being printed. Printing on both sides, referred to as duplex printing, can create an impression of a more professionally prepared document, when appropriately bound, while also reducing file storage space requirements, media expense, shipping expenses and other handling expenses, particularly for long documents.

In a duplex printing operation, after an image is printed on a first side of the substrate, the substrate must be reversed in some fashion to present the opposite side of the substrate for printing. For proper appearance of a duplex printed document, the image on the second side should be positioned on the substrate similarly to the image on the first side of the substrate. That is, the top, bottom and side spacings should be the same on each side of the substrate, and both images should be properly aligned with the edges of the substrate. Numerous types of substrate reversal systems are known, including systems that merely turn the substrate over, as well as systems that reverse the substrate lengthwise and turn the substrate over. The image application procedure and substrate reversal system are selected so that the tops and bottoms of the images on both sides are in the desired relationship.

In today's world there is more and more focus on the economy especially in the area of paper usage. One example of this relates to the recent energy star regulations, in which any device that has a printing speed of ≧45 pages/minute must ship the duplexer included. The most popular duplex architecture is an internal design. This is effective in keeping the overall size of the device as small as possible.

There are two areas in which the internal duplex design has problems. First, they are not able to accommodate a wide range of media due to the tight turn radius of a paper path, the motor control design and the overall paper path length. For example, some printers can only support 16 to 28 pound plain paper and only in limited sizes. The second problem is that the performance of the printers drop off significantly in terms of sides/minute duplex which is much lower than pages/minute in the simplexed mode.

What is needed in the art is an internal duplex design that can support a wide range of media and provide improved performance cost effective manner.

SUMMARY OF THE INVENTION

The present invention relates to a printing assembly showing a duplex paper path.

The invention in one form is directed to an imaging apparatus including an image transfer device, a first motor, a redrive section and a duplexing section. The first motor is drivingly connected to the image transfer device. The reversible redrive section is downstream from the image transfer device, and the reversible redrive section includes a second motor. The duplexing section includes a third motor. The duplexing section is positioned to receive media from the redrive section. The first motor, the second motor and the third motor are each independently controlled.

An advantage of the present invention is that the speed of the paper in the three separate sections can be independently controlled.

Another advantage of the present invention is that the paper in the redrive and duplexing paths be driven at a much higher speed than the base paper path.

Yet another advantage of the present invention is that a page can be held in the duplex section while another page is being printed in the base paper path.

Still yet another advantage of the present invention is that multiple pages can be moving independently in the three separate sections that define a paper path.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates an embodiment of the invention, in one form, and such exemplification is not to be construed as limiting the scope of the invention in any manner.

DETAILED DESCRIPTION OF THE INVENTION

Figure 1:
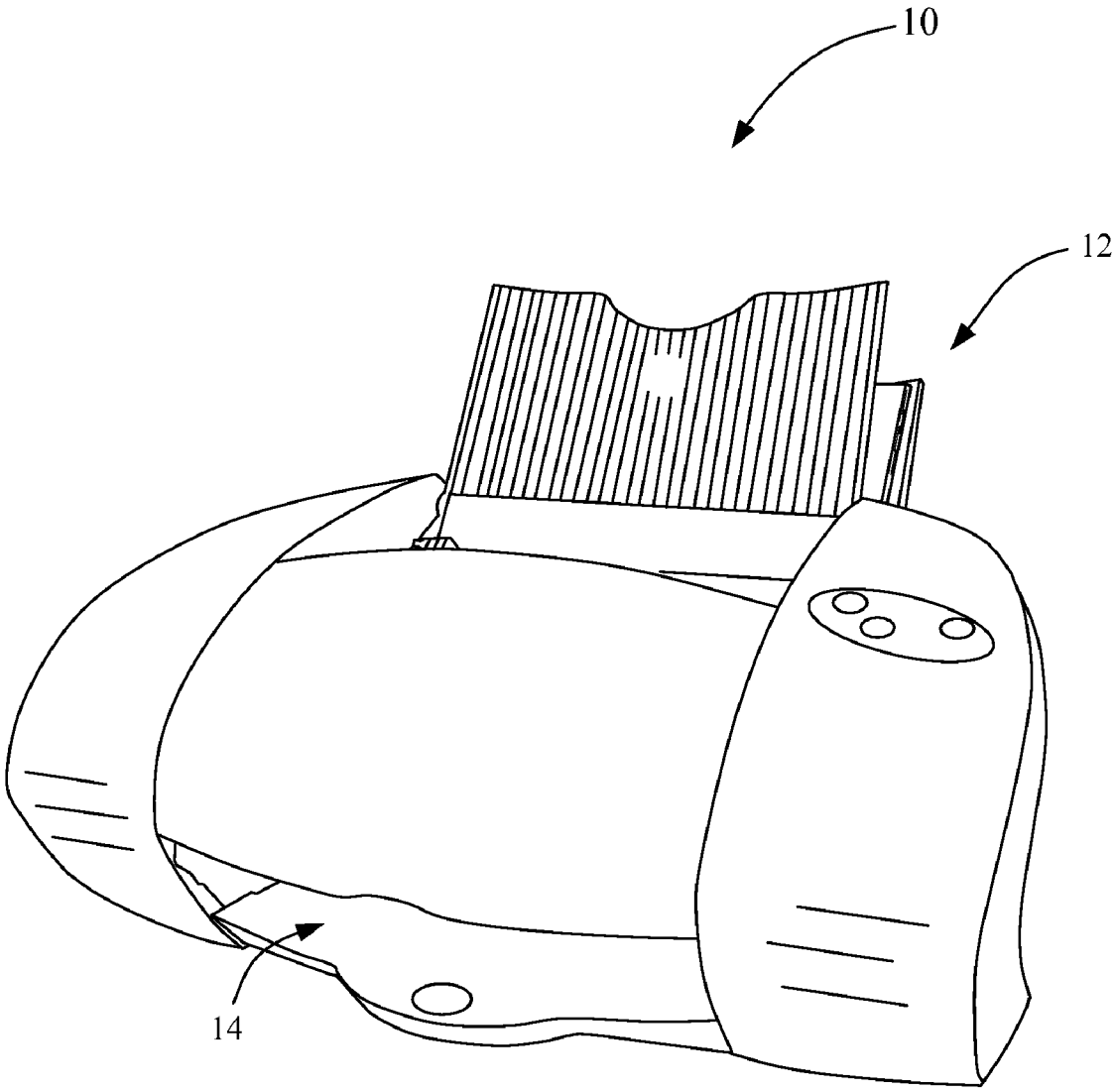
FIG. 1 is a perspective view of an imaging apparatus in the form of a printer that incorporate an embodiment of the split drive architecture of the present invention.

Referring now to the drawings, and more particularly to FIG. 1, there is shown a perspective view of an imaging apparatus 10, which for the ease of illustration is also known as a printer 10 having a paper tray 12 and a finished printed tray 14. Printer 10 incorporates an internal duplex system herein described as a split drive duplexing architecture.

Figure 2:
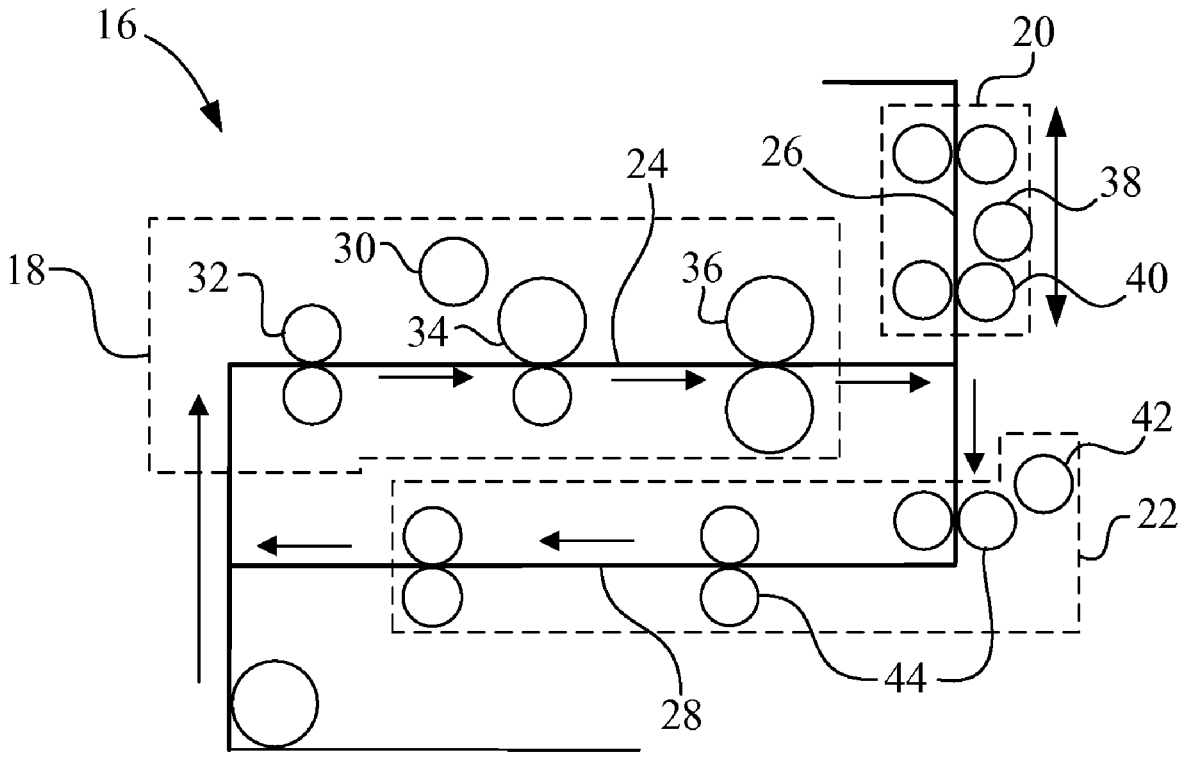
FIG. 2 is a schematical view of paper paths of an embodiment of the split drive system of the present invention utilized in the printer of FIG. 1.

Now, additionally referring to FIG. 2 there is shown a schematic view of a media transport system illustrated as split drive system 16 that is incorporated into printer 10. Split drive system 16 includes a base engine section 18, a redrive section 20, a duplexing section 22, respectively having paper paths 24, 26 and 28. Sections 18, 20 and 22 are independently controlled, each having a defined paper path and an independently driven motor controlling the speed at which media traverses each section.

Base engine section 18 also known as an imaging section 18 includes a motor 30, an aligner 32, an imaging device 34, which may be a drum 34 for transferring of an image therefrom to the media or a printhead 34 directly placing text and graphics upon the media. Section 18 additionally includes a fuser 36 for the fusing of toner onto the media positioned downstream from drum 34.

Redrive section 20 includes a reversible motor 38 and rollers 40 for the transport of the media while the media is in redrive section 20. Motor 38 is not only reversible but also has a variable speed that drives the media at speeds under the control of a controller 46.

Duplexing section 22 includes a motor 42 and rollers 44 for the transport of a media in duplexing section 22. Motor 42 drives in only one direction and may be a variable speed motor. Rollers illustrated herein are for the purpose of explanation of the invention and are not limited to the number, position or size in the illustrations. The rollers of each section are utilized by that section and if driven are driven by the motor of that particular section. Further, the positioning of the rollers in each section have been selected to allow at least three pages to be separately controlled in the overall paper path of printer 10.

Figure 3:
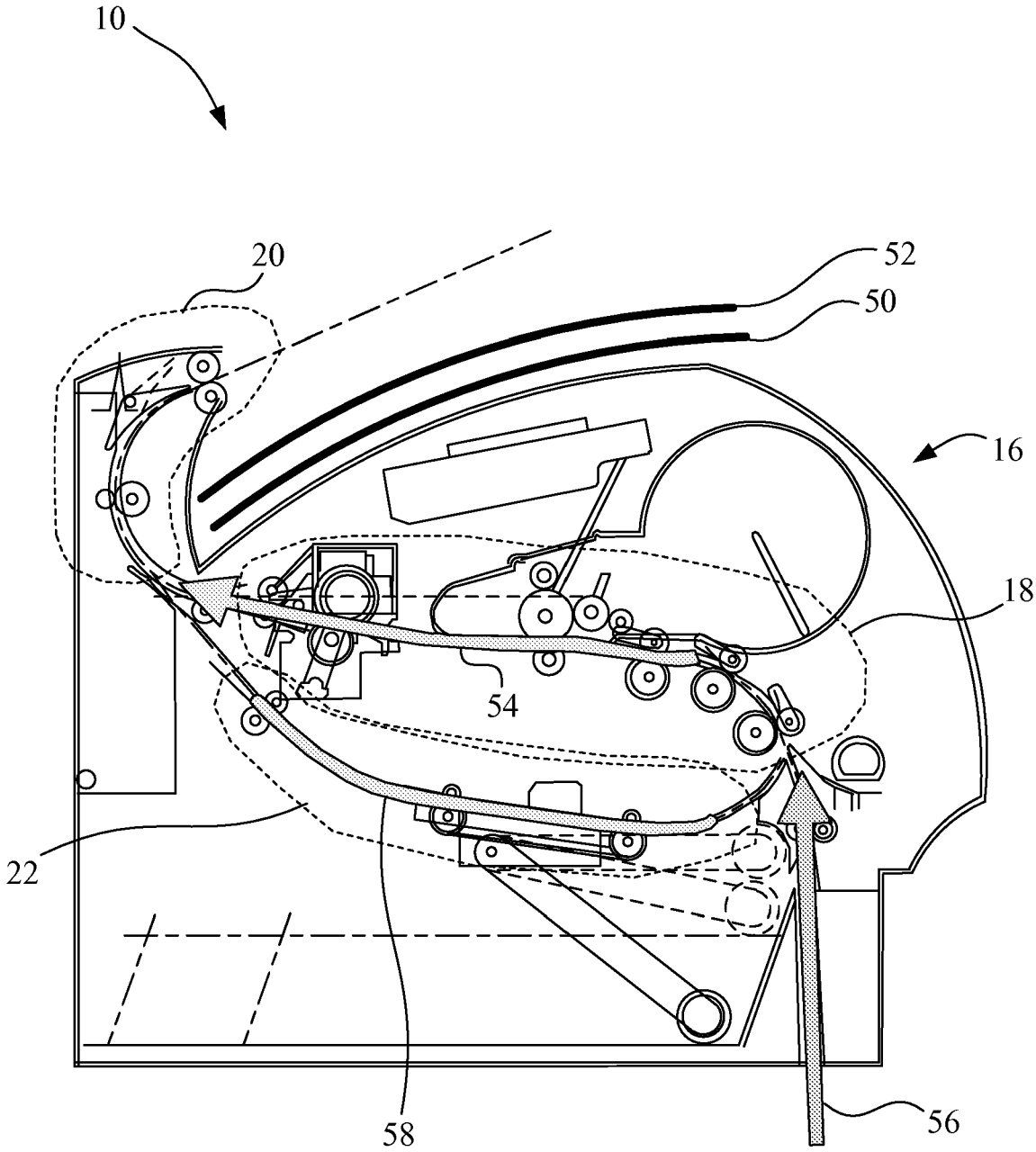
FIG. 3 is a quasi-schematical sectioned side view of a the printer of FIGS. 1 and 2.
Figure 4:
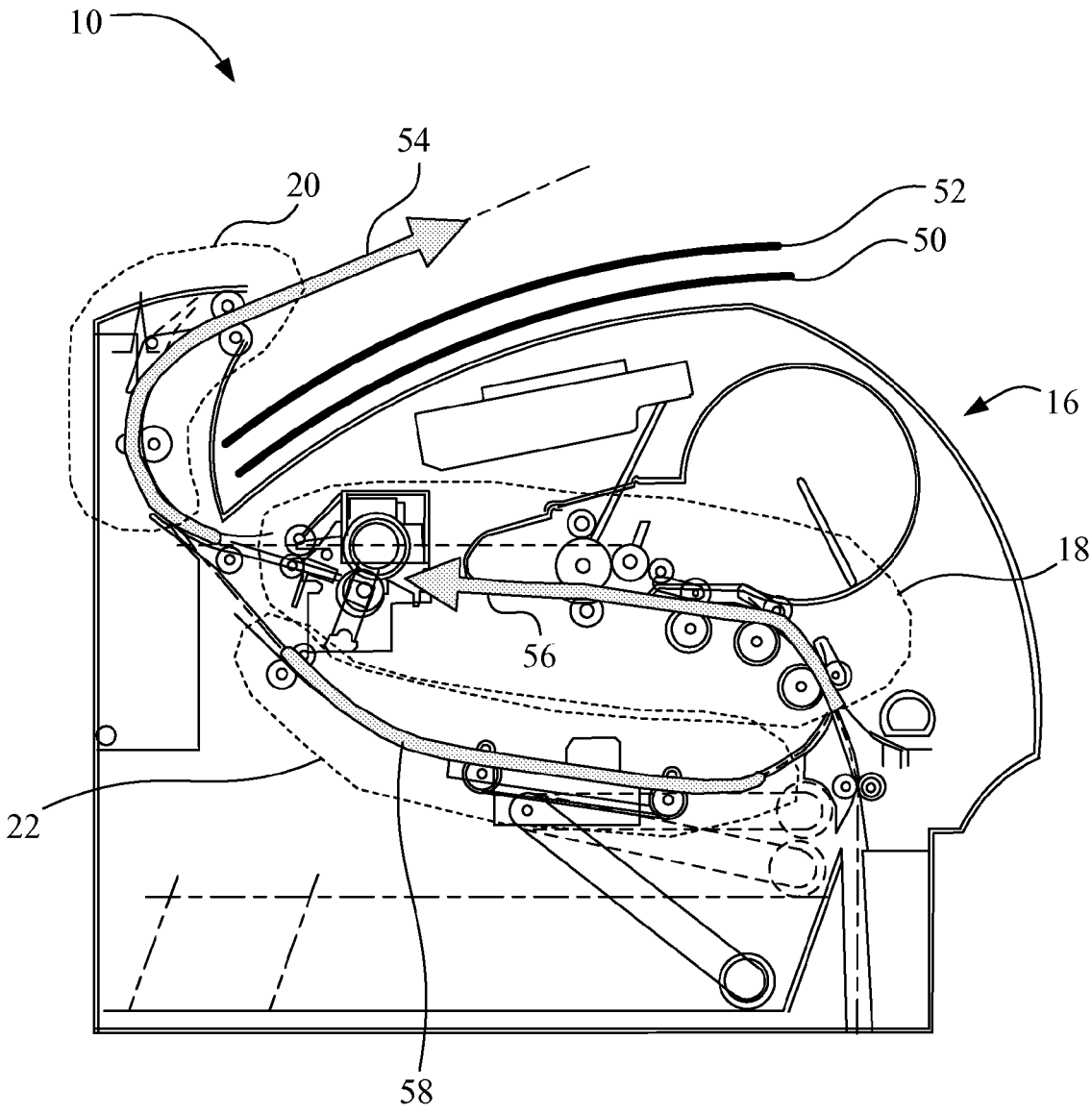
FIG. 4 is another quasi-schematical sectioned side view of the printer of FIG. 3 showing an advancement of the paper flow.
Figure 5:
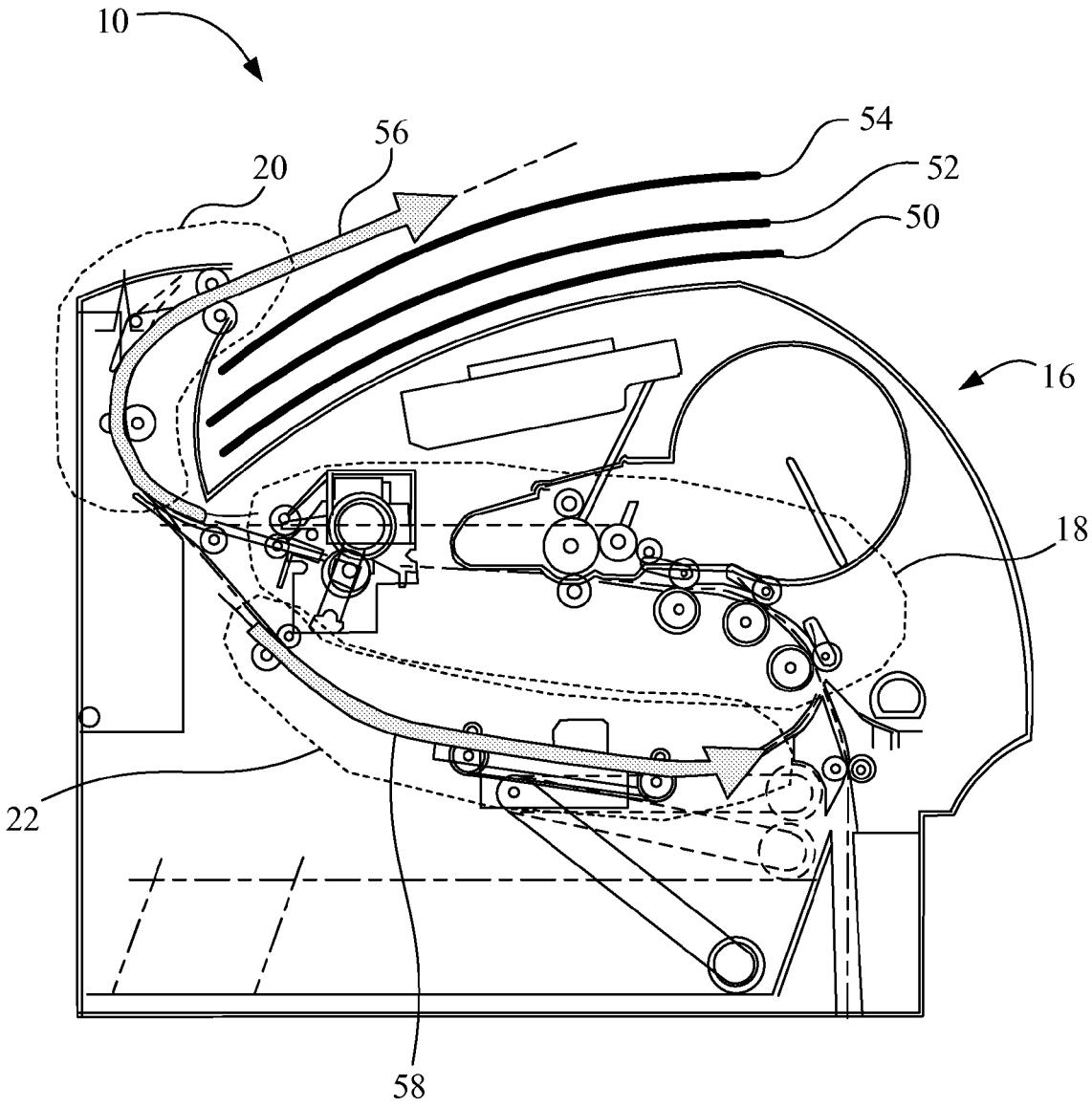
FIG. 5 is another quasi-schematical sectioned side view of the printer of FIG. 4 showing a further advancement of the paper flow.
Figure 6:
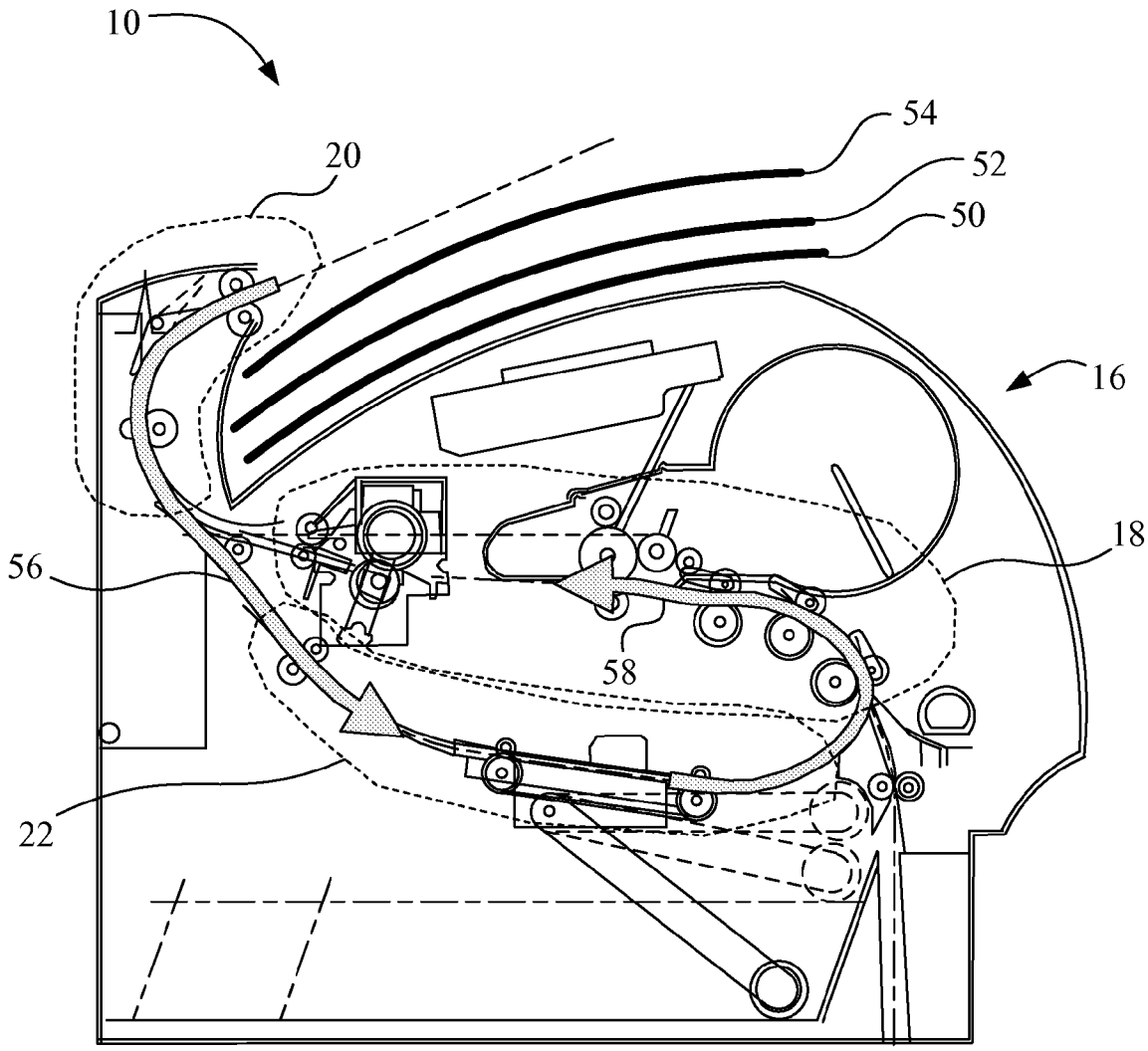
FIG. 6 is another quasi-schematical sectioned side view of the printer of FIG. 5 showing yet another advancement of the paper flow.
Figure 7:
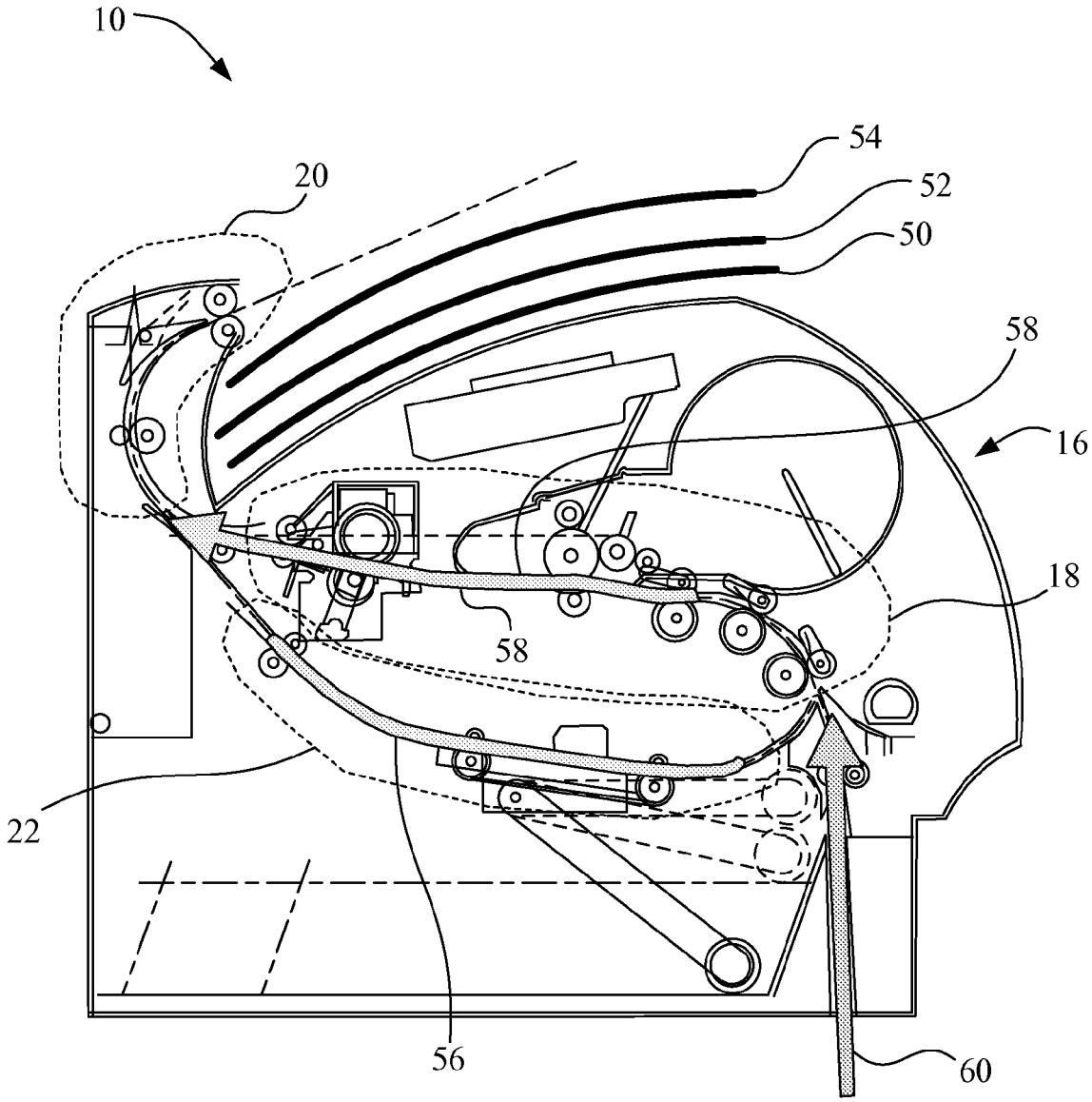
FIG. 7 is another quasi-schematical sectioned side view of the printer of FIG. 6 showing an even further advancement of the paper flow.

Now, additionally referring to FIGS. 3-7 there is illustrated a movement of pieces of media, hereinafter referred to as paper pages to illustrate the operation of the present invention. Pages 50-60 are illustrated at different positions in the flow as they go through sections 18, 20 and 22 as appropriate. In FIG. 3 pages 50 and 52 have been delivered to output tray 14. Page 54 is transitioning from section 18 to redrive section 20 as illustrated by the arrow thereon. Meanwhile a new page 56 is entering into a section 18 for the placement of an image thereon. Page 58 is being held in duplexing section 22 and is illustrated in a stopped position. Now in FIG. 4, page 54 is traveling through redrive section 20 while page 56 is having an image placed thereon in section 18. Page 58 remains in duplexing section 22. Now, in FIG. 5 page 54 has left redrive section 20 and is now in tray 14. Page 56 is being driven into redrive section 20 until it completely exits section 18. Meanwhile page 58 is entering into section 18 from duplexing section 22. Duplexing section 22 has motor 42 which drives page 58 at a very high rate of speed so that it may then enter section 18 in an expeditious manner. Now, in FIG. 6, page 58 has entered into base engine section 18 as it leaves duplexing section 22 and page 56 is entering duplexing section 22 and it may wait or be timed so that the reverse side can be printed thereon in the proper sequence. Now, referring to FIG. 7 a new page 60 enters section 18 as page 58 leaves section 18 and is entering redrive section 20. Since page 58 has been printed on each side it will be transported to tray 14 by way of redrive section 20. The selection of simplex or duplex printing for page 60 will then determine whether page 60 exits redrive section 20 or is rerouted through duplexing section 22. Perhaps following page 60, or at some later point, page 56 will then enter into base section 18 for printing on a reverse side thereof.

Figure 8:
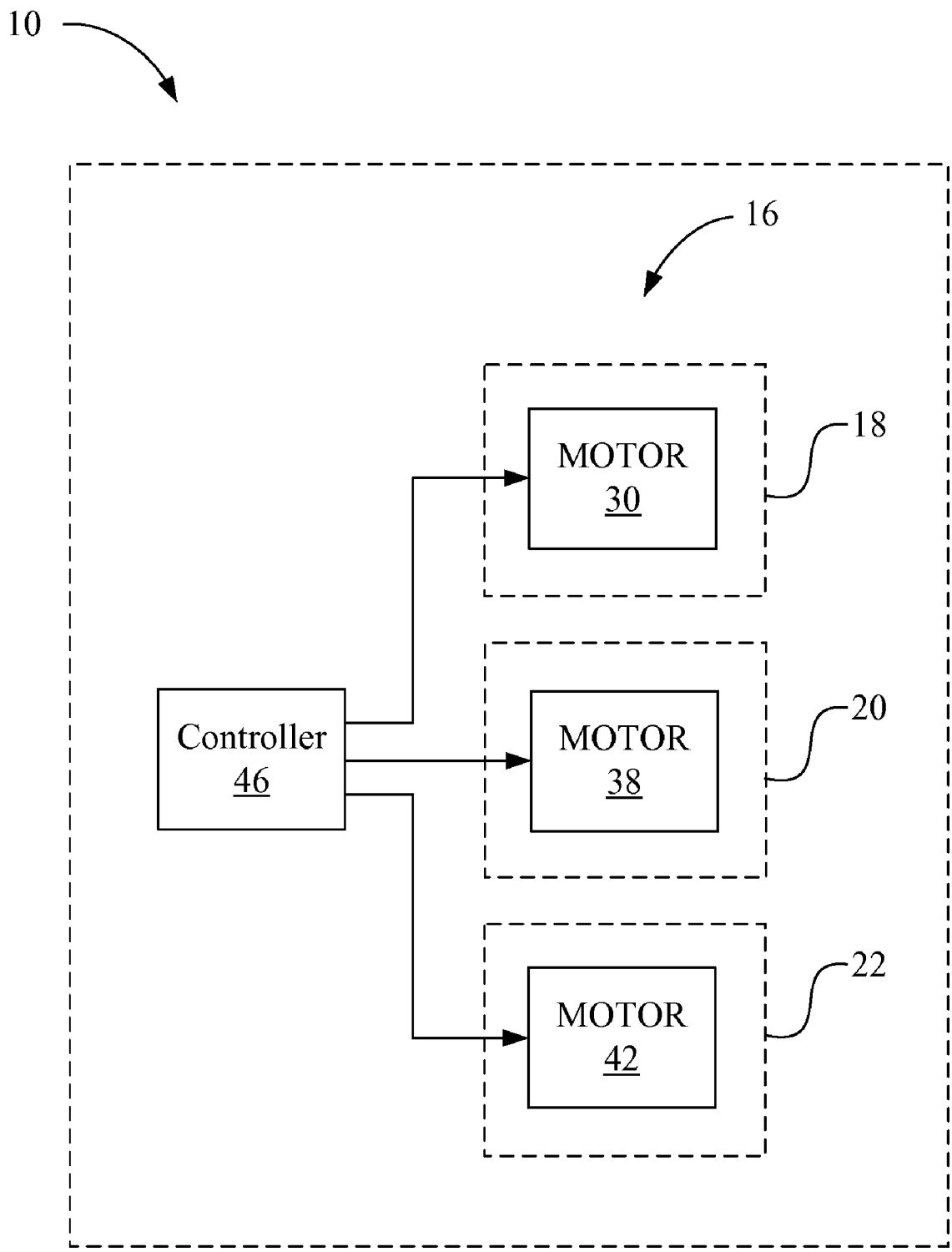
FIG. 8 is a schematical block diagram of the functions of the printers illustrated in FIGS. 1-7.

Now, additionally referring to FIG. 8 there is shown a portion of imaging apparatus 10 having a split drive system 16 including a controller 46 that independently controls motors 30, 38 and 42. Motors 30, 38 and 42 are shown as being respectively in sections 18, 20 and 22. Controller 46 independently controls the speed of motors 30, 38 and 42. Additionally, motor 38 is reversible to reroute the paper to duplexing section 22.

The present invention achieves an internal duplex design, which can support a wide range of media types and media weights and delivers speeds close to simplex performance by the dedicated motor control systems for each of the redrive, the internal duplex path and the base path. The present invention is able to address the power and handoff requirements needed for the wide range of media size and type, and the associated timing necessary to deliver faster printing speeds. Paper path turn radiuses are made so that they support a wide range of media weights, for example from 16 pound to 90 pound paper weights. The roller spacing in the paper paths can be advantageously situated to support sizes from A5 up to 33 inch banner media.

Often during the use of a printer paper is printed in a combination of duplex and simplex jobs. For example, it is not unusual for a duplex job to be followed by a simplex job. The present invention can start the duplex page then pick the simplex page while the duplex pages are reversing into the duplex path. In this sequence the simplex page adds no additional job time to what is needed to just print the duplex page. This advantageously leads to reduce job time for many applications that are sensitive to mixed demands of simplex and duplex jobs.

Split drive system 16 is able to accommodate multi-sheets in the path and achieve higher throughputs without impacting the base engine speed. FIG. 2 shows how the paper path is split. Motor 30 drives media through paper path 24 in a forward direction. Motor 38 drives the media in paper path 26 in a forward or reverse direction. Motor 42 in duplexing section 22 drives the media in duplexing section 22 in a forward direction only. The breaking up of the paper paths in the split internal duplex design allows for independent control of the three paper paths 24, 26 and 28 to thereby achieve higher throughput in printer 10. Split drive system 16 allows for the simultaneous control of multiple sheets either at a common paper speed, or different paper speeds or at times even stopping a sheet as needed to support the robust timing of the production of printed jobs. Until the media is handed off to each section each drive has independent control of each sheet. This flexibility provides for more robust paper feed reliability, higher throughput and faster time to first print.

As previously mentioned split drive system 16 allows for variable return speeds of the media in either redrive section 20 and/or duplexing section 22. This flexibility is important for several reasons including superior performance over a wide range of media lengths. For example, when feeding more common size letter and A4 media the variable speed return can be optimized to balance performance and acoustics, but for longer media like folio and legal media, the return speed can be increased to provide consistent timing and performance in the transport of larger media sizes. Another advantage of split drive system 16 is that even faster speeds available for unique customer applications. The architecture of split drive system 16 allows for a variable return speed and overall has a flexibility for the printer to print faster than classic duplex methods. Another advantage of the present invention is that there is no need to change the base engine process speed. Another dynamic of the present invention is that it is tolerant of gap variations that occur in the normal fixed/feed sequence by dynamically adjusting timing that occurs within the split drive system 16.

A further advantage is that controller 46 can allow the simplex path, which is a combination of paper path 24 and the forward portion of paper path 26 to function in the event there is an issue with duplex path 28. Controller 46 detects a problem and alerts an operator and allows printer 10 to continue functioning as a simplex printer while deactivating duplexing section 22. Further, controller 46 may be configured by a user to disable duplex path 28 and use printer 10 as a simplex printer. Printer 10 includes the sensors and an algorithm that utilizes the sensors to determine problems as they occur in printer 10. The algorithm actively reconfigures printer 10 to continue to function, even if in a less than optimal manner, by deactivating features that have failed to function properly. The algorithm identifies the problems to an administrator or user for user intervention and to remedy the problem.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus, comprising:

an image transfer device;

a first motor drivingly connected to said image transfer device;

a reversible redrive section downstream from said image transfer device, said reversible redrive section including a second motor; and a duplexing section including a third motor, said duplexing section being positioned to receive media from said redrive section;

said first motor, said second motor and said third motor each being independently controlled, said first motor moving a first piece of media in a first paper path at a first speed, said second motor moving a second piece of media in a second paper path at a second speed, and said third motor moving a third piece of media in a third paper path at a third speed, wherein said first speed, said second speed and said third speed are all different from each other and further wherein said third motor holds said third piece of media in said duplexing section at a zero speed some portion of the time while said first motor moves said first piece of media in said first paper path at a non-zero speed.

2. The imaging apparatus of claim 1, wherein said first motor and said third motor are each driven in only one direction and said second motor is reversible.

3. The imaging apparatus of claim 1, wherein at least one of said second speed and said third speed is higher than said first speed some portion of the time.

4. The imaging apparatus of claim 1, wherein at least one of said second speed and said third speed is variable and said first speed is substantially constant.

5. The imaging apparatus of claim 1, further comprising a controller including a status determination means that determines the functioning of said duplexing section, when said duplexing section is not functioning properly said controller does not activate said third motor and said first motor and said second motor are utilized to thereby allow the imaging apparatus to function in a simplex only mode.

6. A media transport system for use in a printer, the media transport system comprising:

an imaging section;

a first motor associated with said imaging section;

a reversible redrive section downstream from said imaging section, said reversible redrive section including a second motor; and a duplexing section including a third motor, said duplexing section being positioned to receive media from said redrive section, said first motor, said second motor and said third motor each being independently controlled, wherein said first motor moves a first piece of media in a first paper path at a first speed, said second motor moves a second piece of media in a second paper path at a second speed, and said third motor moves a third piece of media in a third paper path at a third speed, wherein said first speed, said second speed and said third speed are all different from each other and further wherein said third motor holds said third piece of media in said duplexing section at a zero speed some portion of the time while said first motor moves said first piece of media in said first paper path at a non-zero speed.

7. The media transport system of claim 6, wherein said first motor and said third motor are each driven in only one direction, said second motor being reversible.

8. The media transport system of claim 6, wherein at least one of said second speed and said third speed is higher than said first speed some portion of the time.

9. The media transport system of claim 6, wherein at least one of said second speed and said third speed is variable and said first speed is substantially constant.

10. The media transport system of claim 6, further comprising a controller including a status determination means that determines the functioning of said duplexing section, when said duplexing section is not functioning properly said controller does not activate said third motor and said first motor and said second motor are utilized to thereby allow the media transport system to function in a simplex only mode.

11. A method of transporting media in a printer, the method comprising the steps of:

controlling a first motor to drive a first piece of media in an imaging section;

controlling a second motor to drive a second piece of media in a reversible redrive section, said reversible redrive section being downstream from said imaging section; and controlling a third motor in a duplexing section that is positioned to receive media from said reversible redrive section, said first motor, said second motor and said third motor each being independently controlled, wherein said first motor drives said first piece of media in a first paper path at a first speed, said second motor drives said second piece of media in a second paper path at a second speed, and said third motor drives said media received from said reversible redrive section in a third paper path at a third speed, wherein said first speed, said second speed and said third speed are all different from each other and further wherein said third speed of said media received from said reversible redrive section is held at zero speed some portion of the time while said first motor moves said first piece of media in said first paper path at a non-zero speed.

12. The method of claim 11, wherein said controlling said first motor step moves said first piece of media in a paper path at a first speed, said controlling a third motor moves said second piece of media in another paper path at a variable speed.

13. The imaging apparatus of claim 1, wherein at least one of said second speed and said third speed is variable based on a length of each of said first piece of media, said second piece of media, and said third piece of media.

* * * * *